US010180220B2

(12) United States Patent
Eddins

(10) Patent No.: US 10,180,220 B2
(45) **Date of Patent: *Jan. 15, 2019**

(54) ARCHITECTURAL LIGHTING METHODS AND APPARATUS

(71) Applicant: Inception Innovations, LLC, Southlake, TX (US)

(72) Inventor: Scott Eddins, Southlake, TX (US)

(73) Assignee: Inception Innovations, LLC, Southlake, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/976,742

(22) Filed: May 10, 2018

(65) Prior Publication Data

US 2018/0259142 A1 Sep. 13, 2018

Related U.S. Application Data

(63) Continuation of application No. 14/205,219, filed on Mar. 11, 2014, now Pat. No. 9,989,206.

(Continued)

(51) Int. Cl.

| | |
|---|---|
| ***F21S 4/28*** | (2016.01) |
| ***F21S 8/00*** | (2006.01) |
| ***F21S 8/04*** | (2006.01) |
| ***F21V 3/06*** | (2018.01) |
| ***F21S 10/02*** | (2006.01) |
| ***F21V 15/01*** | (2006.01) |
| ***F21V 23/00*** | (2015.01) |
| ***F21V 31/00*** | (2006.01) |
| ***F21V 21/005*** | (2006.01) |
| ***F21W 121/00*** | (2006.01) |
| ***F21Y 103/10*** | (2016.01) |
| ***F21Y 113/10*** | (2016.01) |
| ***F21Y 113/13*** | (2016.01) |

(Continued)

(52) U.S. Cl.

CPC ..... *F21S 8/033* (2013.01); *F21S 4/28* (2016.01); *F21S 8/04* (2013.01); *F21S 10/02* (2013.01); *F21V 3/062* (2018.02); *F21V 21/005* (2013.01); *F21V 23/001* (2013.01); *F21V 31/005* (2013.01); *F21V 15/013* (2013.01); *F21W 2121/004* (2013.01); *F21Y 2103/10* (2016.08); *F21Y 2113/10* (2016.08); *F21Y 2113/13* (2016.08); *F21Y 2113/17* (2016.08); *F21Y 2115/10* (2016.08)

(58) Field of Classification Search

CPC ..... F21S 8/033; F21S 4/28; F21S 8/04; F21S 10/02; F21V 3/062; F21V 21/005; F21V 23/001; F21V 31/005

See application file for complete search history.

(56) References Cited

U.S. PATENT DOCUMENTS 6,183,104 B1 * 2/2001 Ferrara ..... F21S 2/005 362/145
9,033,542 B2 * 5/2015 Peck ..... F21V 13/04 362/222

(Continued)

*Primary Examiner* — Mary Ellen Bowman
(74) *Attorney, Agent, or Firm* — Peter V. Schroeder

(57) ABSTRACT

An enclosed lighting unit for use with light strips is provided to enable installation of architectural lighting. The lighting unit has cooperating base and cover which are assembled by hand. The unit encloses a channel supporting the light strips which maintain a clearance distance between the light sources and the cover.

24 Claims, 11 Drawing Sheets

Related U.S. Application Data

(60) Provisional application No. 61/775,922, filed on Mar. 11, 2013.

(51) Int. Cl.
*F21Y 113/17* (2016.01)
*F21Y 115/10* (2016.01)

(56) References Cited

U.S. PATENT DOCUMENTS

| | | | | |
|---|---|---|---|---|
| 9,989,206 | B2 * | 6/2018 | Eddins | F21S 10/02 |
| 2005/0180135 | A1 * | 8/2005 | Mayer | F21V 3/04 362/240 |
| 2006/0076908 | A1 * | 4/2006 | Morgan | H05B 33/0842 315/312 |
| 2010/0148673 | A1 * | 6/2010 | Stewart | H05B 33/0803 315/121 |

* cited by examiner

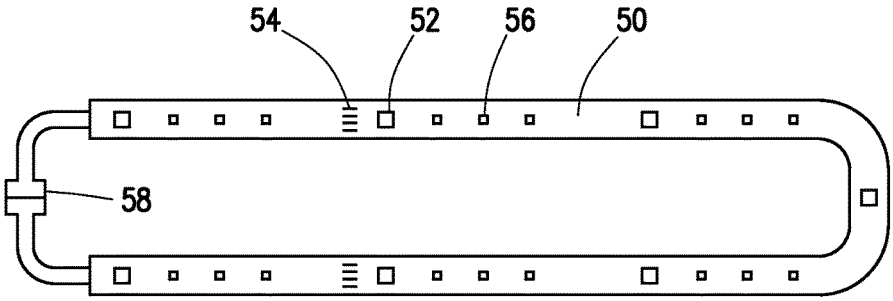
*FIG. 3*
*FIG. 4*
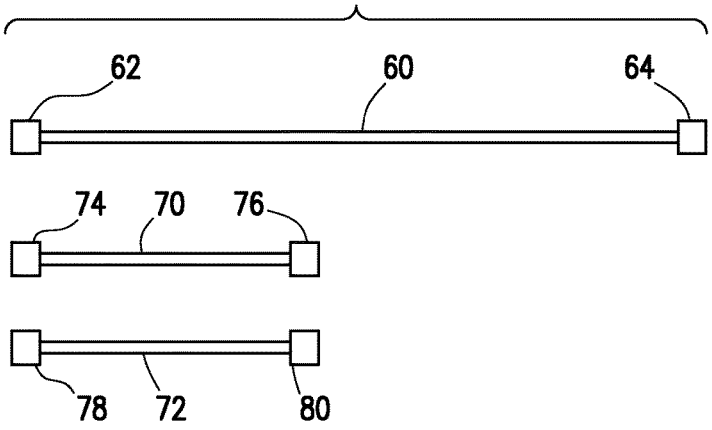

ARCHITECTURAL LIGHTING METHODS AND APPARATUS

CROSS-REFERENCE TO RELATED APPLICATIONS

The present application is a continuation application of U.S. patent application Ser. No. 14/205,219 filed Mar. 11, 2014, which is a non-provisional application of Provisional Application No. 61/775,922, filed Mar. 11, 2013.

TECHNICAL FIELD

The present disclosure is in the technical field of outdoor architectural lighting. More particularly, the present disclosure is in the technical field of the extrusion method of manufacturing. More particularly, the present disclosure is in the technical field of LED lighting.

BACKGROUND

The present state of the art in the field of outdoor architectural lighting does not provide a method to UV protect and disguise linear LED lighting while facing forward to provide direct lighting and allowing for custom fit to accommodate custom architectural shapes. Present state of the art in the extrusion method of manufacturing does not provide a method to enclose LED lighting and provide UV protection for forward facing architectural lighting. Present state of the art do not provide outdoor rated enclosures for forward facing linear LED lighting wherein the LED lighting can be removed and replaced within the same enclosure.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which:

FIG. 3 is a top view of an LED strip of the present invention;

FIG. 4 is a top view of the connectors needed for the LED lights of the present invention;

DETAILED DESCRIPTION OF PREFERRED EMBODIMENTS

Figure 1:
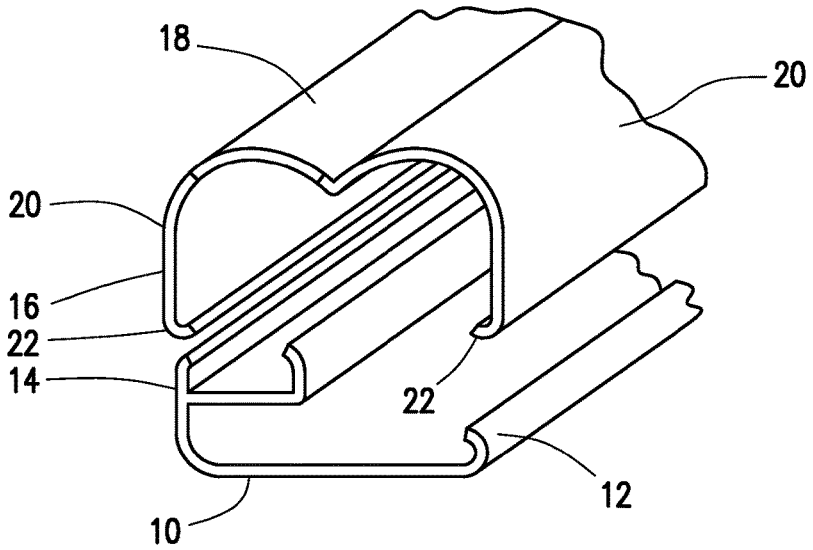
FIG. 1 is a perspective view of the protective LED lighting enclosure of the present invention.

The present inventions and disclosures are described by reference to drawings showing one or more examples of how the inventions can be made and used. In these drawings, reference characters are used throughout the several views to indicate like or corresponding parts. In the description which follows, like or corresponding parts are marked throughout the specification and drawings with the same reference numerals, respectively. The drawings are not to scale and proportions of certain parts have been exaggerated to better illustrate details and features.

Directional terms, such as "up," "down," "upward," downward," and the like, are made with reference to the accompanying figures unless otherwise indicated and are not to be taken as limiting the embodiments in their orientations of use.

The present disclosure relates to a low-voltage, discreet, outdoor rated, forward-facing linear architectural lighting system designed for custom installation. The disclosure provides LED lighting enclosures with UV protection and space for wiring and connections to be enclosed with a base. A lighting channel is provided for securing LED strips or modules and a lid protects the lights and provides a clear lens for light to shine through. Adequate room for wiring is provided for increased versatility and customization of installation. Both the LED light strips and the lighting enclosure are customizable in length and can be cut to round corners for a custom installation. The enclosure is UV resistant and the LED lighting is water resistant to provide long life even in direct sunlight and damp conditions. The lid of the enclosure is co-extruded to allow for a clear "stripe" or window. The lid and enclosure are designed to position the LED lights directly behind the clear portion to allow the LED lights to shine through without significant distortion. A discreet appearance is maintained such that the architectural lighting units blend with the surrounding architecture. The LED strip lighting extends along significant lengths while providing low-voltage linear lighting and without losing acceptable brightness due to voltage drop often associated with strip or string lighting. The LED strips can be replaced without the need to replace the enclosure for ease of maintenance.

Referring now to the invention in more detail, in FIG. 1 there is shown an extruded linear, nonmetallic base 10 with a flat back, raised connection ridges 12 running along the sides to allow for a lid 16 to attach and a light channel 14 to hold an LED strip or module. The base 10 should be wider than the light channel 14 to allow space for wiring and connections to be ran inside when the lid 16 is attached. The lid 16 is made using a co-extrusion process to create a clear stripe 18 running the length of the lid positioned above the light channel 14 when closed to allow light to shine through. The lid 16 also has colored material 20 on either side of the clear portion to help the lid to blend with the architecture. The lid 16 has connection ridges 22 running down the edges to allow the lid 16 to attach to the base. The lid 16 must allow for connection and wiring space when attached to the base.

In further detail, still referring to FIG. 1, the base 10 can be attached to any flat surface using staple, screw, nail or adhesive depending on the surface requiring one-quarter of an inch clearance above and below the base 10 placement to attach the lid 16.

The construction details of the invention of FIG. 1 are a material that can be extruded. The base 10 has a channel 14 for holding in place the LED lighting and room for connections to be placed when the lid 16 is attached and a material that can be co-extruded for the lid 16 to create a clear stripe 18 running lengthwise to allow the full viewing angle of light from the LED source to shine through the clear stripe 18 and provide room for connections to be made and wires to be ran inside the enclosure when the base 10 and lid 16 are attached. The base 10 and lid 16 should be cut into four foot lengths for ease of installation.

Figure 2:
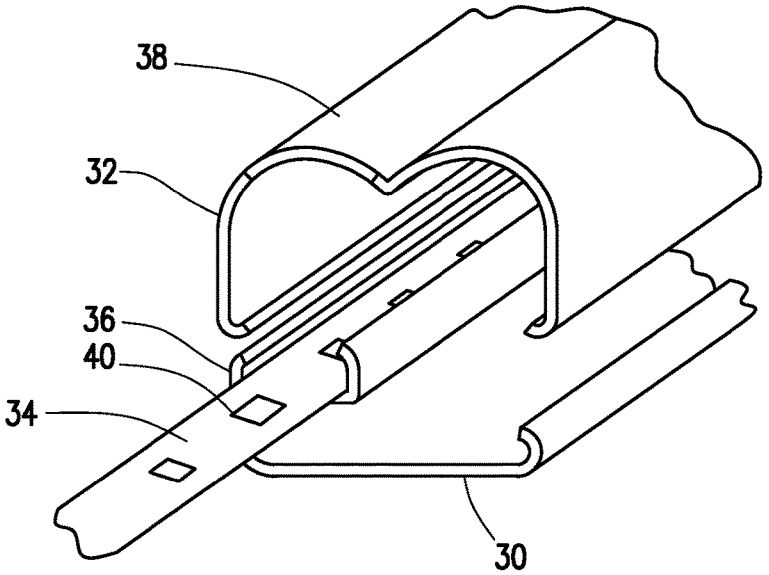
FIG. 2 is a perspective view of the protective enclosure with the light source of the present invention.

Referring now to FIG. 2, there is shown a base 30 and a lid 32 with an LED light strip 34 placed in the light channel 36. The LED lights 40 typically have a one-hundred twenty degree viewing angle, so the clear stripe 38 must be in proximity to the LED lights 40 and be wide enough for all light to shine out to avoid distortion of the light when the lid 32 is attached to the base 30.

Referring now to FIG. 3 as shown is an LED strip 50 must be waterproof to IP65 including connectors 58 to operate in damp conditions. The LED strips 50 must be low voltage in order to extend LED diode life and eliminate the need to dissipate heat created by the LED sources 52. The LED strips 50 have cut marks 54 between every one or two LED sources 52. Resistors 56 must be used to keep a consistent voltage, decrease voltage drop and increase life of the LED sources 52. Voltage drop is experienced at approximately one-hundred-thirty feet with ten inch LED source spacing and use of resistors. Spacing when using connectors 58 at the ends of LED strips 50 must be designed to ensure consistent spacing of LED sources 52 when connecting strips end to end.

In more detail, still referring to FIG. 3, silicone sleeves with silicone caps sealed with silicone glue achieve sufficient weatherproof protection to IP65. The construction of the LED strip 50 is a thin and long, ten millimeter wide and five meters long is currently used in this invention, printed circuit board with LED sources 52 soldered to the printed circuit board 50 spaced at ten inches. As used in the present invention, twenty-four volt RGB LED strips with LED sources spaced between ten and twelve inches create a traditional holiday lighting aesthetic when in use. Cut points 54 every one or two LED sources 52 are required to custom fit the LED strips 50 to make custom lengths for the installation of the invention.

Referring to the invention in further detail, still referring to FIG. 3, the LED sources 52 used in the present invention are RGB LED sources 52 which allow for color-changing. Each LED source 52 has a red a green and a blue LED diode in the LED source 52.

Referring now to FIG. 4 there are shown various connectors required for the custom application of this invention. Jumpers 60 with a female connection 62 at one end and a male connection 64 at one end in lengths of ten, thirty-five and one-hundred feet. Ten inch PCB to waterproof connectors 70 and 72 with compatible connectors to the ones used on the ends of the light strips and the jumpers 60, one with a PCB connector 74 to male waterproof connector 76, and one with a PCB connector 78 to female waterproof connector.

Figure 5:
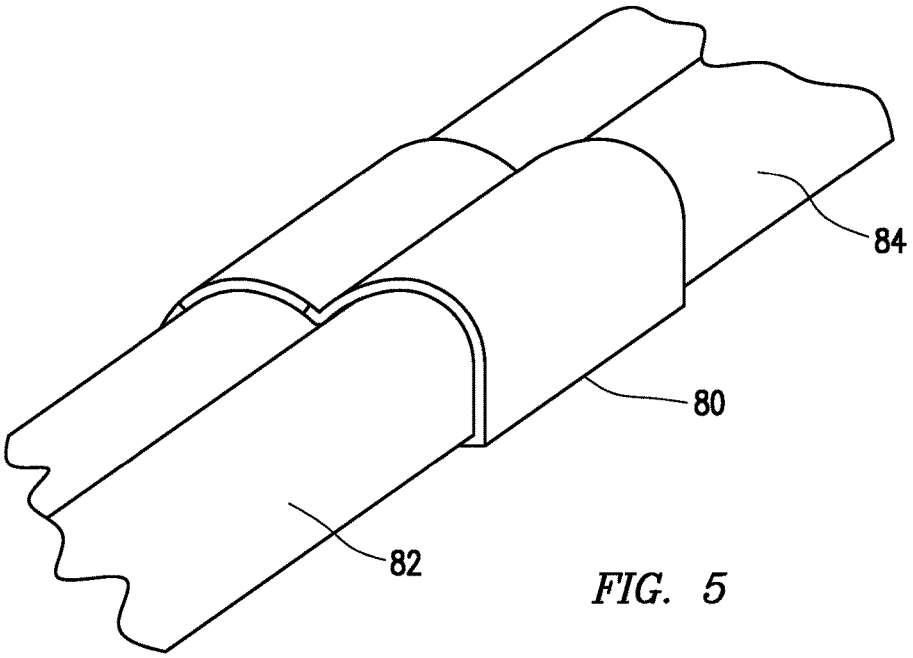
FIG. 5 is a perspective view of a protective enclosure with expansion joint of the present invention.
Figure 6:
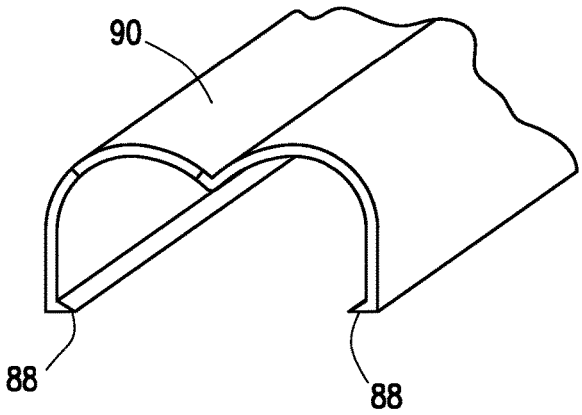
FIG. 6 is a perspective view of the expansion joint of the present invention.

Referring now to FIG. 5 and FIG. 6 as shown is an expansion joint which is a two inch section of extruded or injection molded lid 80 designed to attach over the lid 82 84 with wedge shaped edges 88 and also overlap two pieces of lid 82 84. The expansion joint 80 is required to conceal potential gaps in the lid 82 84 created by the natural expansion and shrinking of materials when exposed to extreme heat and cold.

The construction details of FIG. 5 and FIG. 6 is a co-extruded UV protected material the same as the lid 82 84 with a clear stripe 90 but slightly larger in order to fit over the lid 82 84 and attach to the base with wedge shaped edges 88.

Figure 7:
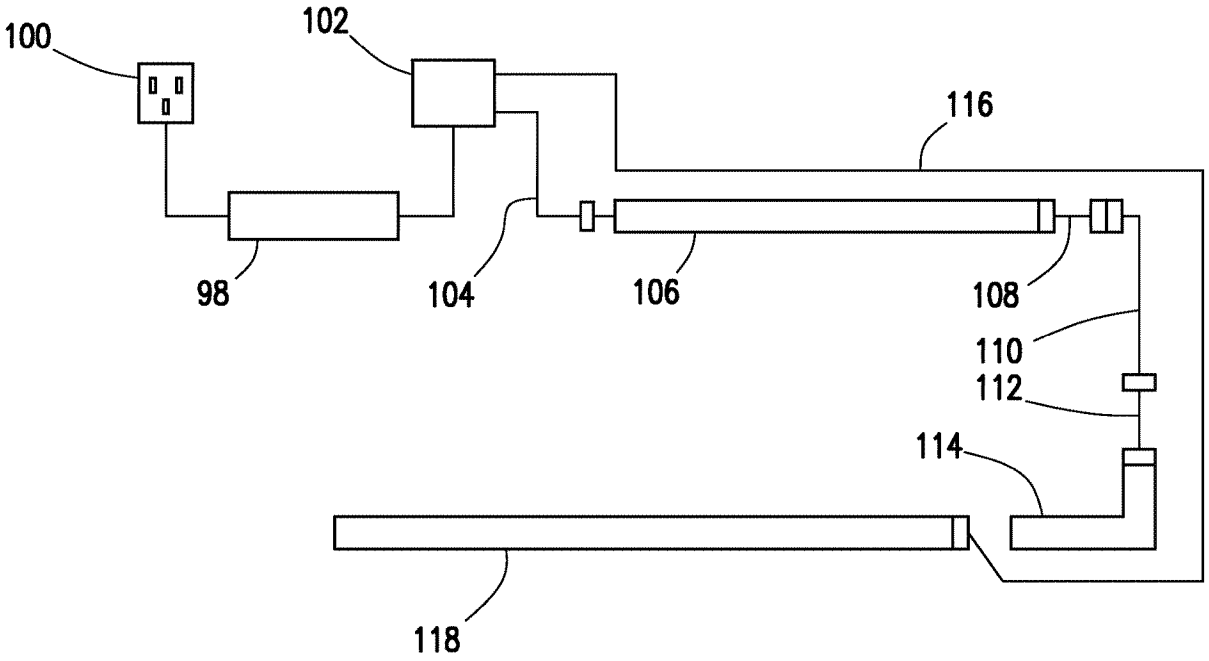
FIG. 7 is a perspective view of a complete connection of the present invention.

In further detail still referring to FIG. 5 and FIG. 6, when using the expansion joint, two pieces of lid 82 84 are installed leaving a half inch gap and the expansion joint 80 is attached over the two pieces of lid 82 84 centered over the gap between the two pieces of lid 82 84. Referring now to FIG. 7 as shown a low voltage electricity transformer 98 plugged into an electrical outlet 100 connected to a lighting controller 102. The controller 102 has two jumpers 104 116 connected to it. One jumper 104 is connected to an LED strip 106. The other end of the LED strip 106 is connected to a PCB to male weatherproof connector 108 connected to a jumper 110 connected to a female weatherproof to PCB connector 112 to another LED light strip 114.

Still referring to FIG. 7, as shown, a jumper 116 extends out to more LED strip lights 118. In more detail, still referring to FIG. 7, jumpers 116 and all connections can be enclosed inside the protective enclosure. Jumpers 104 110 116 as illustrated with jumper 116 can be used to reach beyond one length of LED light 106 118 to extend a greater distance from the control unit 102 after one-hundred and thirty feet of light are placed when voltage drop creates a dimming of the LED sources as experienced with the LED strips that the present invention uses. Jumpers 104 110 116 and PCB to waterproof connectors 108 112 are needed to extend power and data from the control source 102 to the light placement. Gaps in light placement using one LED strip 106 114 can be made by cutting the LED strip 106 at cut points and using a PCB to male waterproof connector 108 connected to a jumper 110 connected to a PCB to female connector 112 attached to the other side of the cut point of the same strip 114 for custom installations of the present invention. Silicone must be used to weatherproof the PCB end of the PCB to male/female connectors 108 112.

In more detail, still referring to FIG. 7, the controller 102 as present in the invention is an RGB, color-changing controller with the ability to port in other control options for control of the LED lights. The controller 102 has internal programming with choices of static colors and color changing options specific for recognized holidays and sport teams that can be easily selected.

The advantages of the present invention include, without limitation, the ability to customize the permanent installation of UV protected, outdoor rated, forward-facing LED lighting with the ability to remove and replace the LED lighting without replacing the protective enclosure. The holiday lighting aesthetic created with the LED source spacing eliminates the need for installing and taking down holiday lighting each year and hence allowing the lights to be used year-round as decorative or utility lighting. The color-changing capability and forward-facing light placement allows the present invention to be used in conjunction with a security system to increase the effectiveness of a security system to direct first responders and communicate the nature of an alarm with a color code. The color-changing control offered with the current invention allows the user to change the color or color-changing of the lights with the touch of a button specific to team colors and commonly accepted holidays.

In broad embodiment, the present invention provides for the use of other linear LED lighting products to obscure the LED sources and provide outdoor protection and custom placement. The enclosure for the LED sources can be a one-piece construction allowing that it can accommodate forward-facing and protected linear LED light placement allowing the ability to change the light source and re-use the enclosure.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

Figure 8:
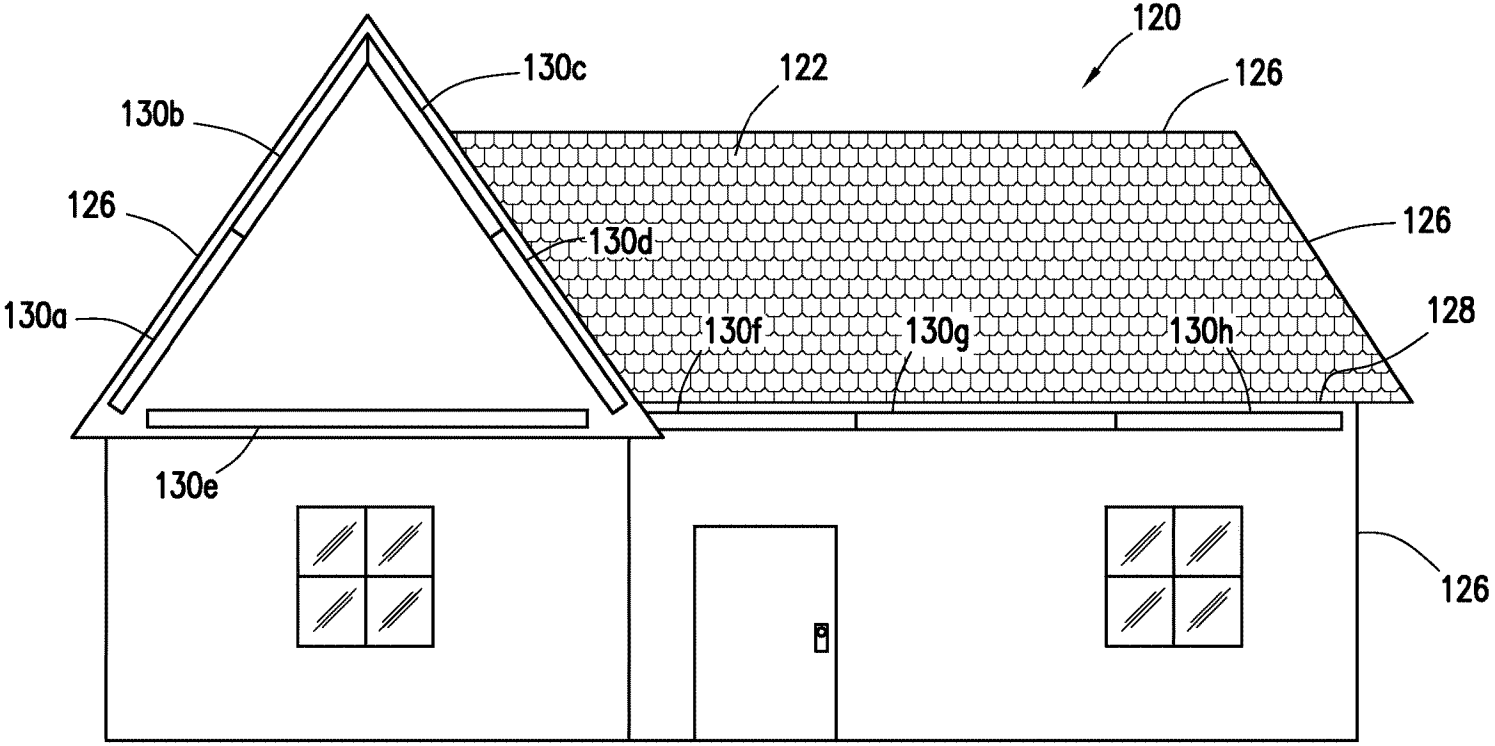
FIG. 8 is a front view schematic of an exemplary building having lighting units applied in accordance with an aspect of the invention.

FIG. 8 is a front view schematic of an exemplary house 120 having a roof 122 and walls 124. Houses suitable for use of the disclosed lighting units can have various roof features 126, such as hips, valleys, ridges, etc., and architectural structures 128, such as eaves, dormers, soffits, rakes, gables, balconies, etc. Exemplary lighting units 130*a-h* are shown mounted onto the house, such as onto or at the eaves and along the gable rake. Buildings and structures suitable for architectural lighting units as disclosed herein are limited only by the imagination of the user.

The architectural lighting units disclosed can be mounted onto any flat surface of sufficient width, whether the surface faces forward, down, or at any other angle. The lighting units can be used on residential or commercial properties, signage, or any other location. The disclosure focuses on lighting units for use with a wired electrical power source (e.g., an electrical socket) but can also be used with other power sources, such as solar units, battery packs, etc. The lighting units can be mounted on stationary or movable surfaces (e.g., a door, rotating or moving signage). The lighting units 130 can be "strung together" or placed end-to-end to provide lighting along longer distances and can be of various lengths to allow users to match the length of the light units to the mounting surface.

Figure 9:
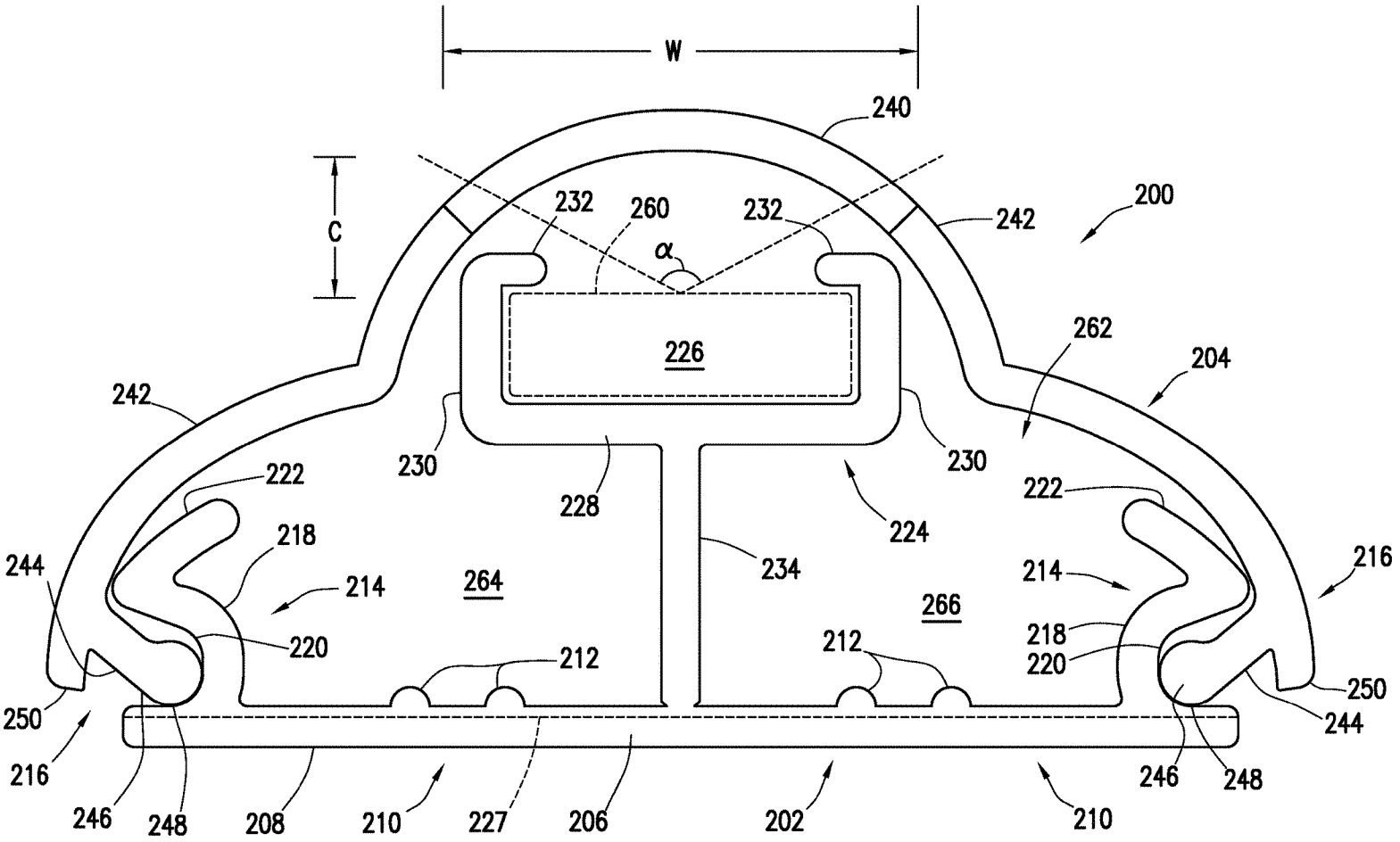
FIG. 9 is a cross-sectional view of an exemplary lighting unit according to an aspect of the disclosure.
Figure 10:
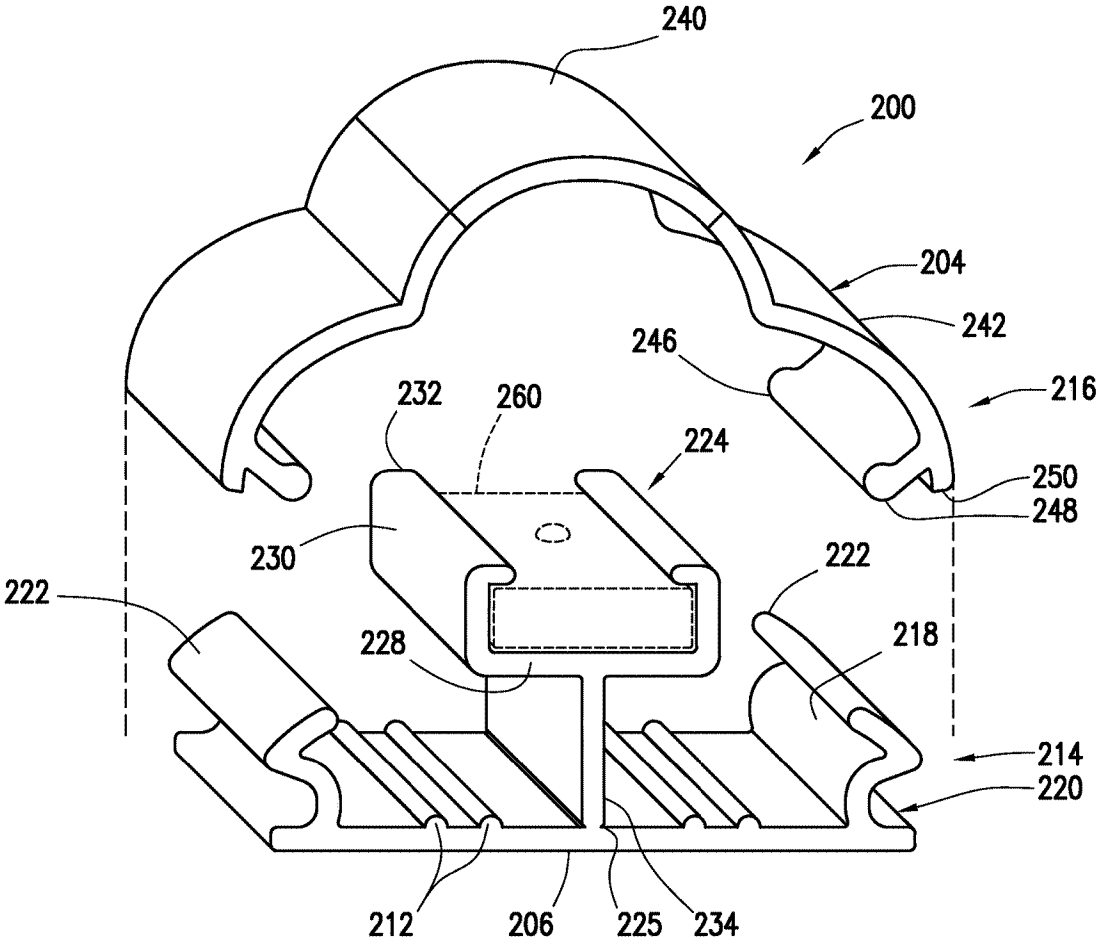
FIG. 10 is an orthogonal, exploded view of the exemplary architectural lighting unit of FIG. 9.

FIG. 9 is a cross-sectional view of an exemplary lighting unit according to an aspect of the disclosure. FIG. 10 is an orthogonal, exploded view of the exemplary architectural lighting unit of FIG. 9. The lighting unit 200 has a base 202 and a cover 204. The cover 204 cooperates with and attaches to a corresponding base 202. It is understood that the lighting unit has a length, L, or longitudinal extent which is not seen in the cross-sectional view.

The base 202 has a mounting plate 206 defining a mounting surface 208 which, when the unit is installed, abuts a corresponding mounting surface defined on the architectural element of the home, building or other structure. The mounting plate 206 can be mounted to a surface by screw, nail, staple, or other fastener. Holes (not shown) can be provided through the mounting plate to indicate attachment points and ease installation, and may be necessary where the base material is too brittle or otherwise not suited for penetration during installation. Alternately, fasteners can simply be driven through the mounting plate. In the embodiment shown in FIG. 9, fastener guides 210, here seen as parallel ridges 212, are provided to indicate preferred locations for attachment. The fastener guides, when used during installation, prevent accidental damage to the lighting unit 200 or portions thereof (e.g., lighting channel 224) and help insure proper installation.

The base 202 has opposing attachment mechanisms 214 which cooperate with corresponding attachment mechanisms 216 of the cover 204. The base 202 supports the cover 204 in use and the cover is attachable to the base using the attachment mechanisms 214 and 216. The specific shape of the attachment mechanisms shown is advantageous, however, other cooperating shapes can be employed to provide a press fit, friction fit, interference fit, interlocking fit, "snap-on" fit, or other integral fasteners. Integral fasteners are preferred for ease of installation, removal of the cover for light replacement, etc. Alternately or additionally, the base and cover can be attached by other mechanical fasteners or by adhesive, for example.

The attachment mechanism 214 defines a flexible arm 218 which elastically flexes inwardly upon engagement with the cover 204 as it is being pressed onto the base. The flexible arm 218 returns to its original position, as shown, once the cover is pressed completely into position. The flexible arm 218 can take various shape, but in the embodiment shown provides a longitudinal recess 220 for receiving a cooperating longitudinal flange 246 on the cover. The flexible arm 218 also defines a generally upwardly facing contact surface 222, at an oblique angle to the base mounting plate 206, which is contacted by the cover during assembly. The angle of the surface 222 causes pressure applied normal to the mounting plate 206 to force the flexible arm inwardly, allowing the cover to "snap" into place.

The base 202 also supports a channel 224 sized to accept and support one or more lighting strips 260, shown in dashed lines in FIG. 9. The channel 224 is generally U-shaped or C-shaped, defining a longitudinally extending space 226. In use, the space 226 is substantially filled by one or more lighting strips 260. The channel 224 is shown having a web 228 to support the lighting strip, two flanges 230 to align the strip, and two lips 232 to retain the strip in position. The channel flanges 230 are flexible and bend outwardly when a lighting strip is pressed into the longitudinal space 226. The longitudinally extending lips 232 can alternately be tabs or other retention member. In an alternate embodiment, the flanges 230 provide a friction fit for the lighting strip and can support or retain the strip in position. The channel 224 is supported away from the mounting plate by a longitudinally extending support member 234 extending upwardly from the mounting plate. The support member 234 can take various shape, but in a preferred embodiment, as shown, divides the interior space 262 of the assembled lighting unit 200 into two conduits 264 and 266.

The channel 224 and support member 234 are preferably made to be easily detached as needed, for example, to make space in the unit for lighting connections. Grooves 225 are provided for this purpose allowing for ease of removal of a length of the support member 234 from the mounting plate 206. Further grooves can be provided on the support member 234 and channel 224 at selected distances along their length for easy removal of selected lengths of channel and support member. Alternately, a plurality of support intervals, comprising a length of channel and support member, can be positioned end-to-end along the base with gaps between adjacent intervals. One or more support intervals can be easily removed to create unobstructed space in the interior 262 of the unit.

The longitudinally extending cover 204 is co-extensive with the base in a preferred embodiment, and has a window 240 positioned between two opposing side walls 242. The walls 242 are preferably opaque, while the window is translucent or transparent to allow light emitted from the light strip to escape the assembly. The cover 204 is preferably monolithic, that is, formed of a single piece. Alternately, the window and side walls can be separate pieces, fitted together and attached to one another.

The cover 204 has opposing attachment mechanisms 216 which cooperate with corresponding attachment mechanisms 214 of the base 202. The cover 204 is supported from the base 202 in use and attaches to the base via attachment mechanisms 214 and 216. The specific shape of the attachment mechanisms 216 shown is advantageous. However, other cooperating shapes can be employed to provide a press fit, friction fit, interference fit, interlocking fit, "snap-on" fit, or other integral fasteners. Integral fasteners are preferred for ease of installation, removal of the cover for light replacement, etc.

The attachment mechanism 216 defines a flexible arm 244 which elastically flexes outwardly upon engagement with the base 202 as it is pressed onto the base. The flexible arm 244 returns to its original position, as shown, once the cover is pressed completely into position. The flexible arm 244 can take various shapes, but in the embodiment shown provides a longitudinally extending flange 246 which is received into and cooperates with the recess 220 of the base arm. The flange 246 is shown having an enlarged end. The flexible arm 244 also defines a generally downwardly facing contact surface 248 which contacts the contact surface 222 of the base attachment mechanism 214 during assembly. The contact surface 248 presses against surface 222, forcing the flexible arm 218 inwardly, allowing the cover to "snap" into place. Additional features may be present on the attachment mechanisms 214 and 216. For example, a gap formed between the detachment lip 250 and base provides a convenient finger or tool hold on which to pull when disassembling the unit by removing the cover. The attachment arms can include stiffening ribs, additional cooperating or locking tongue-and-grooves to enhance retention or tighten the fit, etc.

The cover 204 can have various profiles or shapes and can be of various color or colors. The cover profile shown is selected for its aesthetic appeal and to blend in with existing architectural features of the building. The color of the side walls can be selected to blend into or provide an aesthetically pleasing contrast to the existing colors of the building. A symmetrical profile (along its longitudinal center line) allows for installation of the lighting unit in opposite orientations while maintaining uniformity of profiles among consecutive units. That is, the unit and/or cover can be put on right-side-up or upside-down.

The units are subject to expansion and contraction with temperature changes. Consequently, expansion joints are employed to allow for this relative size change. An expansion joint is created upon installation by creating an expansion gap between adjacent ends of lighting units. The gap is preferably about a half inch upon installation. The expansion gap is bridged by a bridge cover, such as seen in FIG. 5 at 80, which bridges the gap between adjacent covers 82 and 84. The bridge cover 80 preferably is attached to overlap a portion of the covers and centered over the gap therebetween. Further, corner joints, such as between lighting units 130*d* and 130*e* of FIG. 8, can similarly be connected with protective bridge covers suitably shaped to connect adjacent but unaligned units.

Sealant is preferably used at the seams between the base and cover. For example, silicone can be applied along the seams. The sealant seals the interior space, prevents relative longitudinal movement of the base and cover, especially when the unit is installed on an incline, and provides some flexibility and a secure connection of the base and cover during the inevitable expansion and contraction of unit parts.

The window 240 allows emission of light from the unit 200. The unit can be used with, for example, LED lighting strips having multiple LED lights spaced along its length. A wide viewing angle LED lighting strip has a viewing angle $\alpha$ of 120 degrees, as indicated in FIG. 9. The window 240 is preferably of a width, W, to allow light emission throughout at least the full viewing angle $\alpha$. The window can be sized to allow emission of light through other selected viewing angles according to the specifications of the lighting to be assembled into the unit.

The window 240 can be transparent or translucent and can be made of various materials. Preferably the window and side walls 242 are UV degradation resistant and outdoor rated. In a preferred embodiment, the window and walls are of acrylic, although other UV-rated materials can be used.

The window 240 can be made of "diffusion" lighting materials. Diffusion materials are available commercially and are known in the art. Diffusion materials soften and spread light, reducing the contrast ratio between hot-spot areas. Materials include polyester diffusion filters, frosts, flexi-frosts, perforated diffusion, grid cloths, and spun materials all in various densities. Of course, for some applications, such as Christmas or Holiday exterior lighting, diffusion effects are less desirable.

The LED lights should be spaced from the cover 206 and not contact with the cover. Consequently, the channel 224, support member 234, and cover are sized to support the LED lights of the lighting strip a clearance distance, C, below the interior surface of the cover 206. In a preferred embodiment, distance C is at least 1 mm to allow for deformation of and damage to the unit due to handling, transport, installation, general wear and tear, etc.

Conduits 264 and 266 are provided to enclose electrical cords, jumper wires, and the like, and are sized accordingly. At end-to-end joints between adjacent lighting units 200 and adjacent light strips 260, it is necessary to electrically connect the units. The interior space 262 of the unit, with the channel 224 and support 234 removed, is sized to accept electrical connectors. For example, connectors to be enclosed include mating male and female ends of a jumper, electrical cord, electrical wire, four-conductor wire, PCB (printed circuit board) mounting connectors, PCB mounting to waterproof (male/female) connectors, and the like. PCB mounting to waterproof connectors are available, compatible with LED lighting strips, having diameters of about 15 mm. Consequently, the interior space 262 is sized to receive such connectors, with the height from mounting plate 206 to the cover 204 being slightly larger than the connector diameter. Similarly, the cover 204 is shaped to accommodate the connectors in the interior space 262. Preferably the space is sized to accept waterproof connectors, which tend to be larger than regular connectors, since the units are designed for outdoor use. For example, commercially available PCB mount to waterproof connectors are available having a 20 mm diameter. In such a case, the interior space is sized slightly larger to accommodate the connector, for example, at 21-25 mm or larger.

Figure 11:
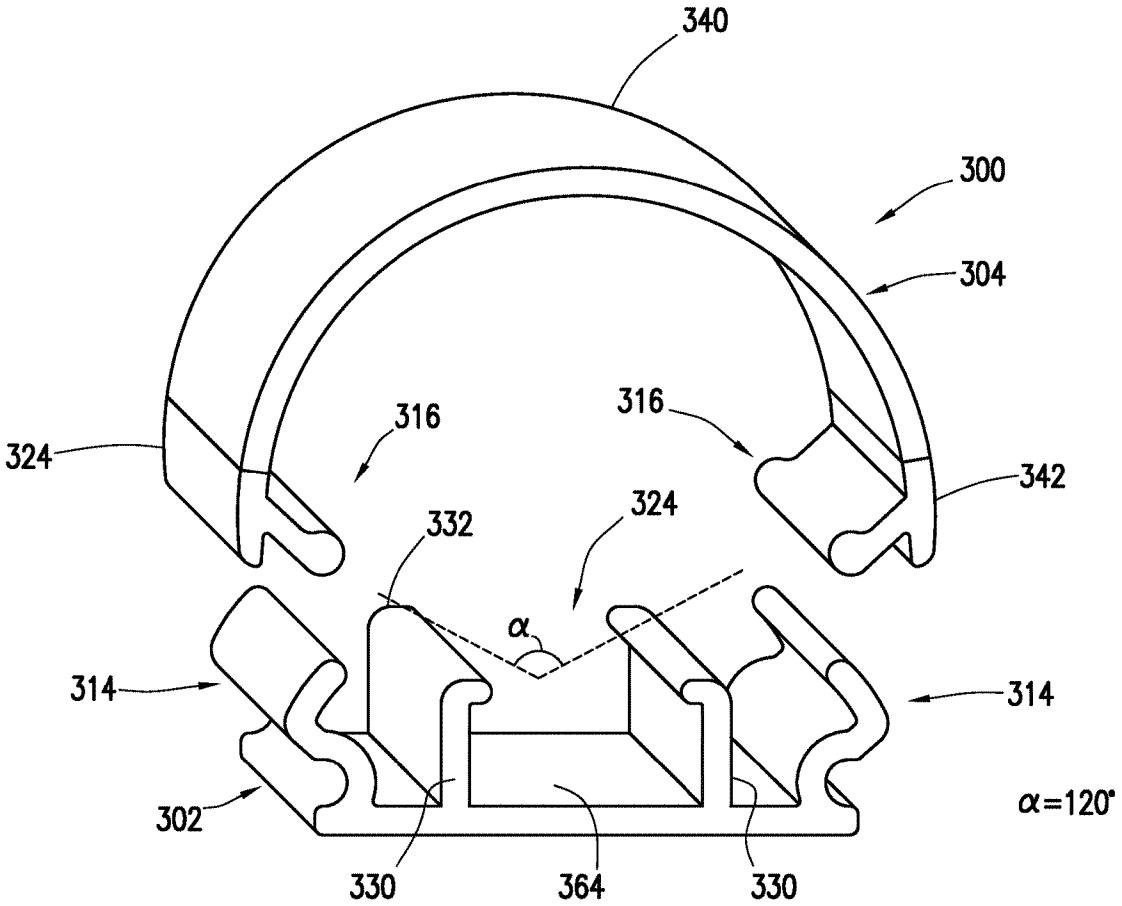
FIG. 11 is an orthogonal view of an exemplary architectural lighting according to an aspect of the disclosure.

FIG. 11 is an orthogonal view of an exemplary architectural lighting according to an aspect of the disclosure. The lighting unit 300 has a base 302 and a cover 304. The cover 304 cooperates with and attaches to a corresponding base 302. The lighting unit 300 has a length or longitudinal extent, L, shown shortened for ease of reference. The lighting unit at FIG. 10 is similar to that described above with reference to FIG. 9 and so will not be described in detail. Like or similar elements are numbered similarly, but in the 300 series rather than the 200 series. As such, not all of the reference numbers are indicated in the Figure and not all reference numbers are discussed with reference to this Figure in particular.

The cover 304 is of an alternate profile, showing the ability to have various cover profiles to fit various aesthetic goals and tastes. The cover 304 is symmetrical along its longitudinal centerline allowing for installation in two orientations. The cover 304 has side walls 342 and a window 340. Alternately, the entire cover can be made of window material. The window provides for emission of light from the unit and, as explained above, is preferably of a width to allow light emission throughout at least the full viewing angle α. The window can be sized to allow emission of light through other selected viewing angles according to the specifications of the lighting to be assembled into the unit. The window can be transparent or translucent, of diffusion lighting materials, and can be made of various materials.

The base 302 has a mounting plate 306, a channel 324, and attachment mechanisms 314 similar to those described above with relation to FIGS. 9-10. Note however that the channel 324 is formed having a bottom 364 defined by the mounting plate 306, and flanges 330 extending upwardly from the mounting plate. Lips 332 retain the lighting strip in the channel. Again, a minimum clearance distance is maintained between the light source and the window. Interior space 362 is sized to accommodate electrical and PCB connectors. In this respect, the flanges 330 can be removed at selected intervals. Grooves or gaps can be provided to ease removal of flange intervals as explained above. Alternately, the interior space can be sized to accommodate the connectors without removal of the channel flanges. In one example, the overall height of the assembled lighting unit is about one inch (25 mm), which provides enough spacing between the LED light sources and a window of diffusion lighting material to sufficiently reduce hot-spots.

Figure 12:
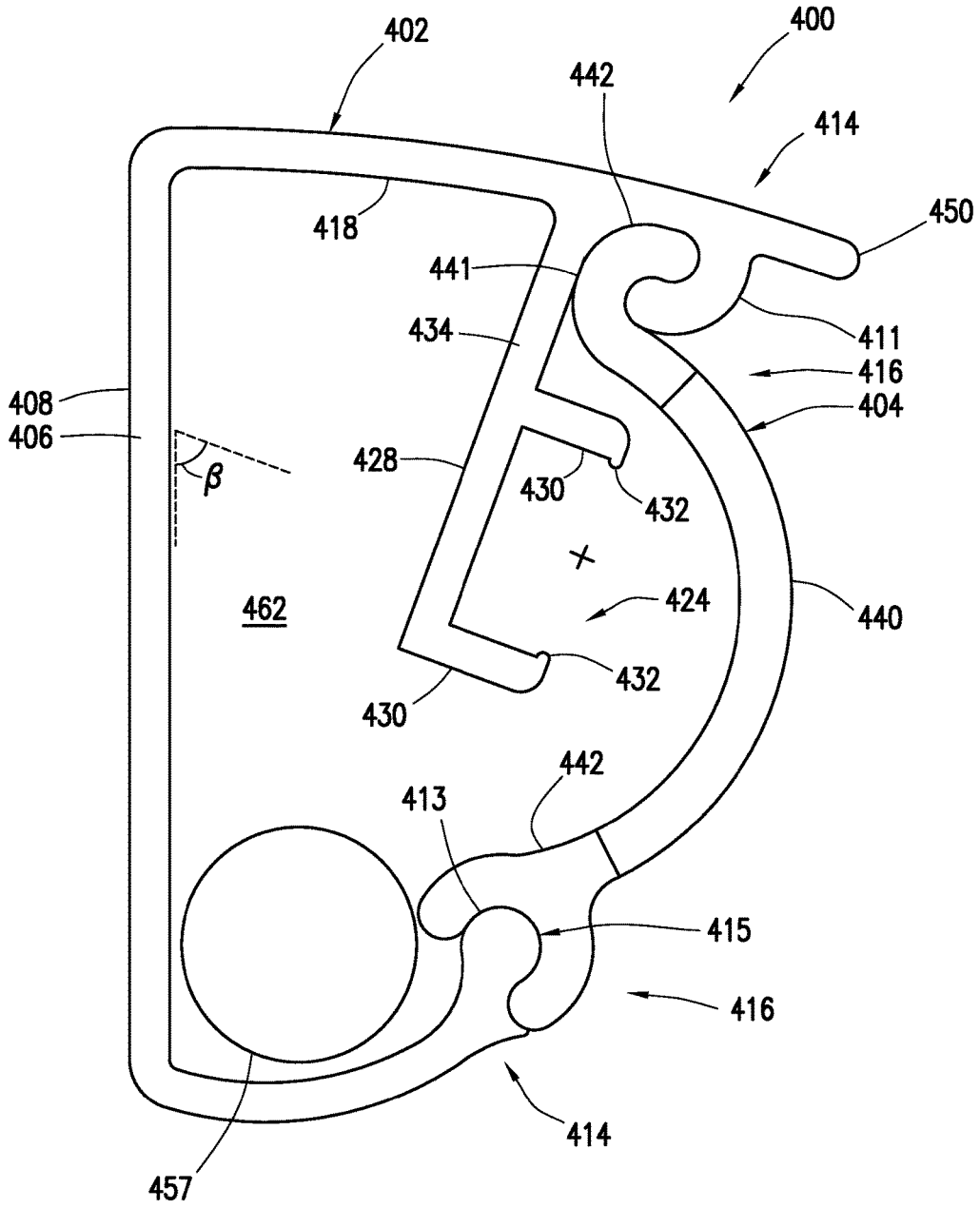
FIG. 12 is a cross-sectional view of an exemplary lighting unit according to an aspect of the disclosure.

FIG. 12 is a cross-sectional view of an exemplary lighting unit according to an aspect of the disclosure. The lighting unit 400 has a base 402 and a cover 404. The cover 404 cooperates with and attaches to a corresponding base 402. It is understood that the lighting unit has a length or longitudinal extent which is not seen in the cross-sectional view. The lighting unit at FIG. 12 is similar to those described above and so will not be described in detail. Like or similar elements are numbered similarly, but in the 400 series, and as such, not all of the reference numbers are indicated in the Figure and not all reference numbers are discussed with reference to this Figure in particular.

The base 402 has a mounting plate 406 defining a mounting surface 408 which, when the unit is installed, abuts a corresponding mounting surface defined by the building or other structure on which it is mounted. The base 402 has opposing attachment mechanisms 414 which cooperate with corresponding attachment mechanisms 416 of the cover 404. The cover is attachable to the base using the attachment mechanisms. The shape of the attachment mechanisms shown is advantageous, however, other cooperating shapes can be employed. The attachment mechanism 414 defines a flexible arm 418 which elastically flexes outwardly upon engagement with the cover 404 as it is pressed onto the base. The elastically flexible arm 418 returns to its original position once the cover is in position. The arm 418 can take various shapes. In the embodiment shown, the upper arm 418 has a curled lip 411 which interlocks with cooperating curled lip 441 of the cover 404. The lower arm 418 defines an enlarged and shaped head 413 which cooperates with a longitudinal recess 415 for that purpose defined in the lower attachment mechanism 416 of the cover 404. The upper flexible arm 418 defines a detachment lip 450 which provides a convenient finger or tool hold for disassembly.

The base 402 also supports a channel 424 sized to accept and support one or more lighting strips. The channel 224 is generally U-shaped or C-shaped, defining a longitudinally extending space 426 for receiving lighting strips. The channel 424 has a web 428, two flanges 430, and two lips 432. The channel 424 is supported by a longitudinally extending support member 434 extending downwardly from the upper flexible arm 418. The channel 424 faces, and holds the lighting strip such that it faces, at an angle β with respect to the mounting plate 406. The embodiment can be modified to provide for various such angles to provide light projection at a selected angle. As described elsewhere herein, the channel 424 and support member 434 are preferably easily detached as needed. Grooves can be provided for this purpose or a plurality of removable support intervals, comprising a length of channel and support member, can be provided with gaps therebetween.

The lights supported in the channel should be spaced from the cover 406 and not in contact with the cover. Consequently, the channel 424, support member 434, and cover are sized to support the lights a selected clearance distance from the interior surface of the cover.

The cover 404 is preferably co-extensive with the base and has a window 440 and opposing side walls 442. The walls 442 can be opaque while the window is translucent, transparent, diffusing, etc. The window 440 is preferably of a width to allow light emission throughout at least the full viewing angle α. The cover can have various profiles, shapes, and colors. Sealant can be used at the seams between the base and cover.

An interior space 462 is defined by the assembled unit and is useful to enclose electrical cords, jumper wires, and the like. At end-to-end joints between adjacent lighting units or adjacent light strips, the interior space 462 is sized to accept the connectors. The channel and support member are preferably removable over selected intervals to enlarge the available interior space to receive such connectors. The distance from mounting plate 406 to cover 404 is slightly larger than the connector diameter (or height). An exemplary electrical cord 457 is shown.

Figure 13:
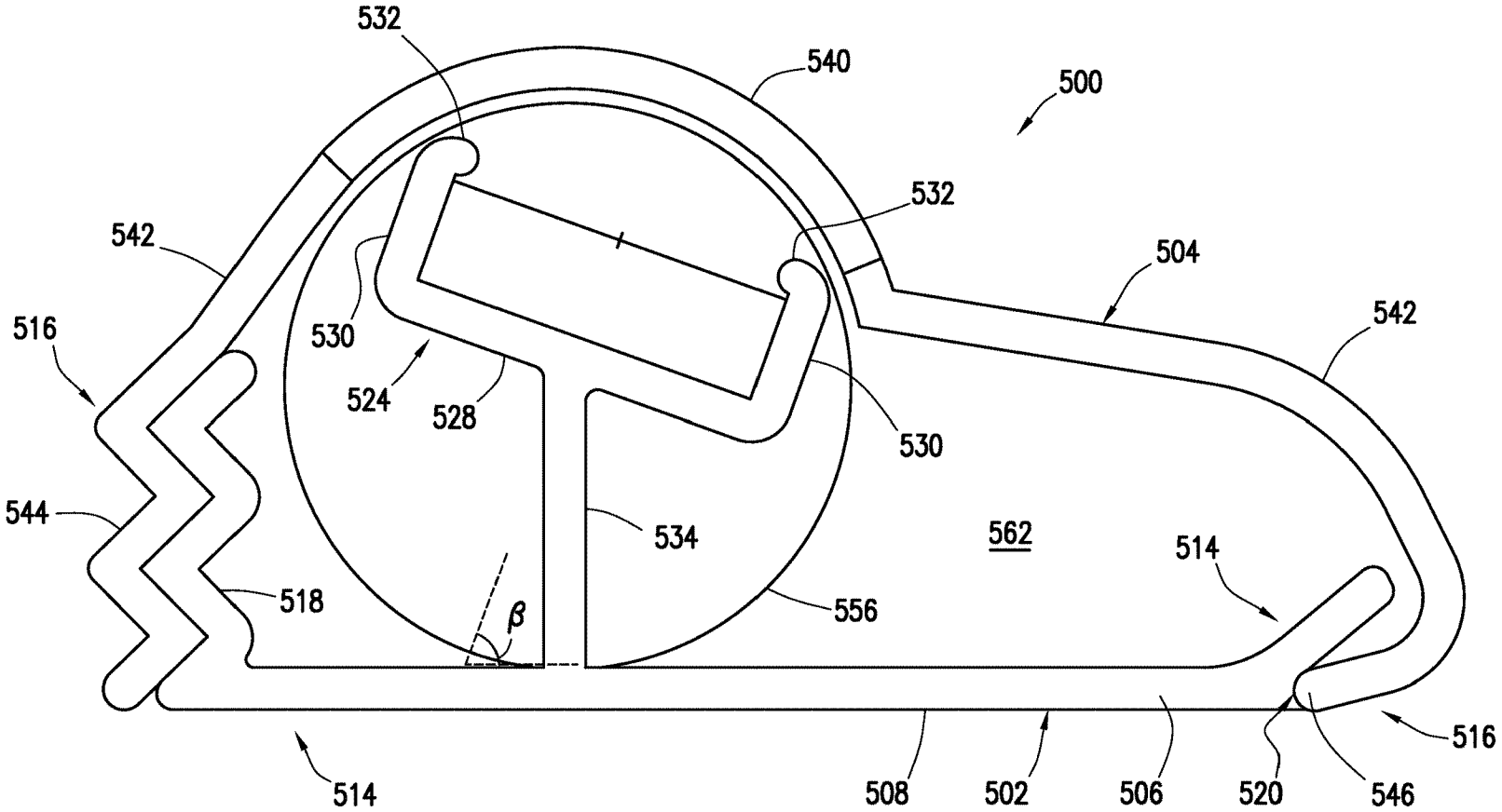
FIG. 13 is a cross-sectional view of an exemplary lighting unit according to an aspect of the disclosure.

FIG. 13 is a cross-sectional view of an exemplary lighting unit according to an aspect of the disclosure. The lighting unit 500 has a base 502 and a cover 504. The cover 504 cooperates with and attaches to a corresponding base 502. It is understood that the lighting unit has a length or longitudinal extent which is not seen in the cross-sectional view. The lighting unit at FIG. 13 is similar to those described above and so will not be described in detail. Like or similar elements are numbered similarly, but in the 500 series, and as such, not all of the reference numbers are indicated in the Figure and not all reference numbers are discussed with reference to this Figure in particular.

The base 502 has a mounting plate 506 defining a mounting surface 508 which, when the unit is installed, abuts a corresponding mounting surface defined by the building or other structure on which it is mounted. The base 502 has opposing attachment mechanisms 514 which cooperate with corresponding attachment mechanisms 516 of the cover 504. The cover is attachable to the base using the attachment mechanisms. The shape of the attachment mechanisms shown is advantageous, however, other cooperating shapes can be employed. The attachment mechanism 514 defines a flexible arm 518 which elastically flexes inwardly upon engagement with the cover 504 as it is pressed onto the base. The elastically flexible arm 518 returns to its original position once the cover is in position. In the embodiment shown, the left arm 518 has a ribbed or corrugated profile which interlocks with a cooperating profile on the left arm 544 of the cover attachment mechanism 516. The right base arm 518 defines a shallow recess 520 which accepts a corresponding lip 546 of the left cover arm 544.

The base 502 also supports a channel 524 sized to accept and support one or more lighting strips. The channel is generally U-shaped or C-shaped, defining a longitudinally extending space 526 for receiving lighting strips. The channel 524 has a web 528, two flanges 530, and two lips 532. The channel 524 is supported by a longitudinally extending support member 534 extending upwardly from the mounting plate 506. The channel 524 is angled to face, and to hold the lighting strip so that it faces, at a selected angle β with respect to the mounting plate 406. The embodiment can be modified to provide for various such angles to provide light projection at a selected angle. As described elsewhere herein, the channel 524 and support member 534 are preferably easily detached as needed and can have grooves or spaced apart intervals for this purpose.

The lights supported in the channel should be spaced from the cover 504 and not in contact with the cover. Consequently, the channel 524, support member 534, and cover are sized to support the lights a selected clearance distance from the interior surface of the cover.

The cover 504 is preferably co-extensive with the base and has a window 540 and opposing side walls 542. The walls 542 can be opaque while the window is translucent, transparent, diffusing, etc. The window 540 is preferably of a width to allow light emission throughout at least the full viewing angle. The cover can have various profiles, shapes, and colors. Sealant can be used at the seams between the base and cover.

An interior space 562 is defined by the assembled unit and is useful to enclose electrical cords, jumper wires, and the like. At end-to-end joints between adjacent lighting units or adjacent light strips, the interior space 562 is sized to accept electrical connectors. The channel and support member are preferably removable over selected intervals to enlarge the available interior space to receive such connectors. The distance from mounting plate 506 to cover 504 is slightly larger than the connector diameter (or height). An exemplary connector 556 is shown, such as a PCB to waterproof connector.

The base and cover of the unit are preferably made to be easily cut-to-length. That is, the materials of the base and cover are easily cut using hand-powered tools. To enhance the ease of cutting the unit parts, they are preferably grooved or otherwise pre-cut or weakened at selected locations. For example, a series of lateral grooves 227, seen at FIG. 9, extending across the base or cover at selected locations along their length, such as every few inches, at locations corresponding to the lengths of available lighting strips, etc. In one embodiment, the unit parts can be bent and broken at the pre-cut grooves relatively cleanly. In another embodiment, the unit lengths are provided corresponding to various LED light strip lengths (e.g., 0.5 m, 2 m, and 5 m) enabling installation with little length modification or cutting.

Figure 14:
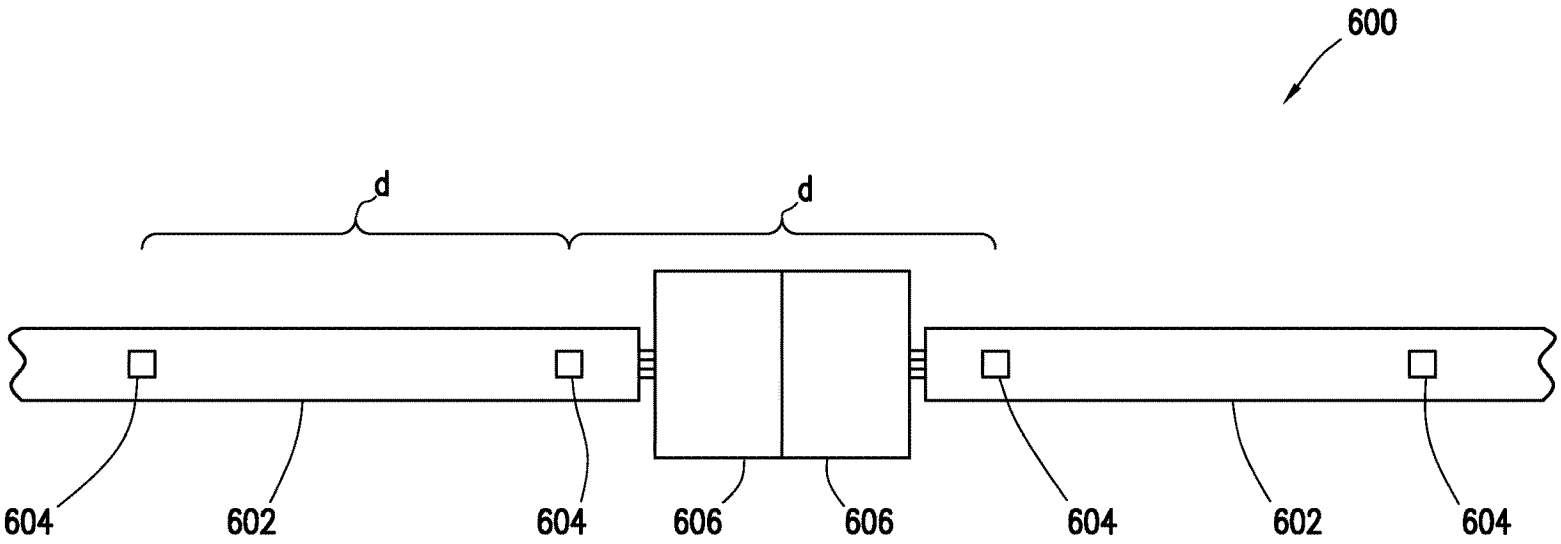
FIG. 14 is a schematic of an exemplary joint assembly between lighting units according to an aspect of the invention.

FIG. 14 is a schematic of an exemplary joint assembly 600 between lighting units according to an aspect of the invention. Two exemplary LED light strips 602, each having a series of light sources 604, are provided. The strip has a printed circuit board (PCB) with multiple, spaced apart LED light sources 604 soldered to the PCB. The light source spacing can vary but in a preferred embodiment is approximately 10 inches. Adjacent strips are connected together by two PCB mounting to waterproof connectors 606. Spacing at the connectors and adjacent strips, according to a preferred embodiment, are designed to ensure consistent spacing between LED light sources across the adjacent strips. That is, the spacing, d, between adjacent light sources 604 on one strip should be equal to the spacing between the closest LED light sources on two adjacent strips. For example, the distance between light sources on a light strip is 250 mm (10 inches). A typical PCB mounting to waterproof connector 606 is approximately 100 mm long. The end-most LED light source on a strip is approximately 25 mm from the end of the strip. Consequently, after installation of the strips 602 and connectors 606, the end-most light sources are approximately 250 mm apart (2×25 mm end gap+2×100 mm connector) which is the same as the spacing between adjacent light sources on a strip. This is only one example of linear spacing of elements to achieve consistent spacing between adjacent light sources. Those of skill in the art will recognize that other dimensions can be employed.

A typical LED light strip is about 10 mm wide and can be of various lengths up to many feet long. In a preferred embodiment, the assembly utilizes four foot long strips and lighting units of the same length to allow for easier handling and transport. In a preferred embodiment, 24V, RGB LED light sources, spaced between 10 and 12 inches apart, create a traditional holiday lighting aesthetic. Cut points between LED light sources can be used to custom fit the strips to custom lengths during installation. The RGB LED sources allow for colors and color-changing lights. Obviously, other types of light source can be used as are known in the art.

The connections and connectors should preferably be waterproof to IP65 standards. Silicone sleeves with silicone caps sealed with silicone glue achieve sufficient weatherproofing. Other sealing materials can be used as are known in the industry.

The light strips are preferably low voltage in order to extend LED diode life and to eliminate the need to dissipate heat. At higher voltages, heat sinks are necessary along the lighting units. Voltage drop across a length of end-to-end connected light strips is dependent on, among other things, applied voltage. For example, use of 24V systems allows for twice the end-to-end connection length of a set of strips when compared to 12V installations. Resistors can be used to keep the voltage consistent and decrease voltage drop across a given length of light strips. The power source and transformers can be employed to power the maximum number of lights allowed according to product specifications.

Significant voltage drop is experienced at approximately one-hundred-thirty feet using the light source spacing described above. The distance at which significant voltage drop occurs depends on type and spacing of light sources, resistors, etc. Where significant voltage drop occurs, it is necessary to provide a jumper or other electrical conductor to deliver power from the power source (e.g., outlet) to a second series of light strips. Jumpers are available in various lengths, such as ten, thirty-five and one-hundred feet, and typically have one male and one female end suitable for connection to other jumpers and to appropriate PCB mounting to connectors. Multiple jumpers, such as jumpers 104, 110, and 116, seen in FIG. 7, and PCB to waterproof connectors, such as connectors 108 and 112, can be used to extend power (and data) from a control source 102 to various light strips.

A typical and preferred controller is an RGB, color-changing controller with the ability to port in additional control options. The controller has internal programming and allows selection of static or changing colors, duration of lighting of a color, modes of transition between color changes (e.g, slow or fast fade), and other lighting effects (e.g., flashing, strobe, etc.). Internal programming can also allow for selection of different colors of white. The color changing options can be used for holidays, to indicate support for a sports team, etc. A typical controller has multiple ports for jumpers. Multiple circuits or series of light strips of RGB lights can be controlled from a single controller. Integrated weatherproof connections attach to the controller for ease of connection.

The base and cover can be made of various materials including metals, plastics, and rubbers. The window can additionally be made of glass. However, the base and cover are preferably UV degradation resistant, UV-rated, and outdoor rated. A preferred material is acrylic or part acrylic. The base and cover can be formed of acrylic or partially acrylic materials to reduce fragility and enhance cutting lengths to shape or acceptance of fasteners through the mounting plate. The base and cover can be manufactured using various methods known in the art, including but not limited to extrusion, co-extrusion, molding, casting, and 3D printing.

The words or terms used herein have their plain, ordinary meaning in the field of this disclosure, except to the extent explicitly and clearly defined in this disclosure or unless the specific context otherwise requires a different meaning. If there is any conflict in the usages of a word or term in this disclosure and one or more patent(s) or other documents that may be incorporated by reference, the definitions that are consistent with this specification should be adopted.

The words "comprising," "containing," "including," "having," and all grammatical variations thereof are intended to have an open, non-limiting meaning. For example, a composition comprising a component does not exclude it from having additional components, an apparatus comprising a part does not exclude it from having additional parts, and a method having a step does not exclude it having additional steps. When such terms are used, the compositions, apparatuses, and methods that "consist essentially of" or "consist of" the specified components, parts, and steps are specifically included and disclosed.

As used herein, the words "consisting essentially of," and all grammatical variations thereof are intended to limit the scope of a claim to the specified materials or steps and those that do not materially affect the basic and novel characteristic(s) of the claimed disclosure.

The indefinite articles "a" or "an" mean one or more than one of the component, part, or step that the article introduces. The terms "and," "or," and "and/or" shall be read in the least restrictive sense possible. Each numerical value should be read once as modified by the term "about" (unless already expressly so modified), and then read again as not so modified, unless otherwise indicated in context.

Whenever a numerical range of degree or measurement with a lower limit and an upper limit is disclosed, any number and any range falling within the range is also intended to be specifically disclosed. For example, every range of values (in the form "from a to b," or "from about a to about b," or "from about a to b," "from approximately a to b," and any similar expressions, where "a" and "b" represent numerical values of degree or measurement) is to be understood to set forth every number and range encompassed within the broader range of values.

While the foregoing written description of the disclosure enables one of ordinary skill to make and use the embodiments discussed, those of ordinary skill will understand and appreciate the existence of variations, combinations, and equivalents of the specific embodiments, methods, and examples herein. The invention should therefore not be limited by the above described embodiments, methods, and examples. While this disclosure has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments. The particular embodiments disclosed above are illustrative only, as the present disclosure may be modified and practiced in different but equivalent manners apparent to those skilled in the art having the benefit of the teachings herein. It is, therefore, evident that the particular illustrative embodiments disclosed above may be altered or modified and all such variations are considered within the scope of the present disclosure. The various elements or steps according to the disclosed elements or steps can be combined advantageously or practiced together in various combinations or sub-combinations of elements or sequences of steps to increase the efficiency and benefits that can be obtained from the disclosure. It will be appreciated that one or more of the above embodiments may be combined with one or more of the other embodiments, unless explicitly stated otherwise. The disclosure illustratively disclosed herein suitably may be practiced in the absence of any element or step that is not specifically disclosed or claimed. Furthermore, no limitations are intended to the details of construction, composition, design, or steps herein shown, other than as described in the claims.

It is claimed:

1. A modular outdoor lighting system comprising:

a plurality of non-metallic, extruded elongate bases mounted generally end to end on a structural surface;

a plurality of non-metallic, extruded elongate covers removably attached to the elongate bases, each cover having a longitudinally extending transparent or translucent stripe adjacent at least one longitudinally extending opaque and colored stripe;

a plurality of spaced apart LED light sources electrically connected to one another, the light sources positioned within an interior passageway defined by the attached bases and covers, the light sources positioned proximate the transparent of translucent stripe to transmit light therethrough.

2. The modular lighting system of claim 1, further comprising a plurality of joint components, the joint components bridging between and attached to two adjacent covers.

3. The modular lighting system of claim 1, wherein the plurality of covers are coextruded.

4. The modular lighting system of claim 2, further comprising at least two adjacent covers positioned unaligned with respect to one another, and a joint component overlapping at least a portion of the two adjacent covers and suitably shaped to connect the two unaligned covers.

5. The modular lighting system of claim 1, further comprising at least one electrical connector positioned between and transmitting power between adjacent light sources and wherein the electrical connector is positioned in the interior passageway.

6. The modular lighting system of claim 1, wherein the light sources are RGB color-changing light sources, and further comprising a color-changing light controller with programming allowing selection of changing colors.

7. The modular lighting system of claim 1, wherein the attached bases and covers are coextensive.

8. The modular lighting system of claim 1, wherein the interior passageway provides spaces for the light sources and for a jumper wire, the jumper wire for providing power to light sources positioned in an adjacent base and cover.

9. The modular lighting system of claim 1, wherein the interior passageway defines first and second passageways and wherein the light sources are positioned in the first passageway and wherein jumper wire is positioned in the second passageway.

10. The modular lighting system of claim 1, wherein the plurality of light sources electrically connected to one another comprise LED strips or modules.

11. The modular lighting system of claim 1, wherein the bases and covers define cooperating shapes which provide for a press fit, friction fit, interference fit, interlocking fit, or snap-on fit between the bases and covers.

12. A modular lighting system comprising:

a plurality of extruded elongate, non-metallic bases mounted to a structural surface;

a plurality of extruded elongate, non-metallic covers removably attached to the bases, each cover having a longitudinally extending transparent or translucent stripe, the plurality of attached bases and covers defining longitudinal interior spaces therein;

a plurality of lighting units, each lighting unit comprising spaced apart and electrically connected light sources, the plurality of lighting units comprising:

a first set of lighting units connected to a first jumper for providing power from a power source to the first set of lighting units, the first set of lighting units positioned in a first set of the interior spaces defined by a first set of bases and a first set of covers; and a second set of lighting units connected to a second jumper for providing power from a power source to the second set of lighting units, the second set of lighting units positioned in a second set of the interior spaces defined by a second set of bases and a second set of covers, the second jumper extending through the first set of interior spaces.

13. A method of installing a modular outdoor rated lighting system comprising:

mounting a plurality of elongate, non-metallic bases generally end to end on a structural surface;

positioning a plurality of light strips or modules in the elongate, non-metallic bases, each light strip or module having a plurality of spaced apart and electrically connected light sources;

removably attaching a plurality of covers to the plurality of bases, each cover having a longitudinally extending transparent of translucent stripe adjacent at least one longitudinally extending opaque stripe, the attached covers and bases defining interior passageways housing the light strips or modules.

14. The method of claim 13, further comprising positioning a jumper wire such that it extends through an interior passageway defined by a first base and a first cover.

15. The method of claim 14, further comprising connecting adjacent covers with joint components.

16. The method of claim 15, wherein connecting adjacent covers with joint components further includes connecting adjacent covers positioned unaligned with respect to one another, wherein the joint component is suitably shaped to connect the two unaligned covers.

17. The method of claim 13, wherein removably attaching a plurality of covers to the plurality of bases further includes attaching the covers to the bases so they are coextensive with one another.

18. The method of claim 13, further comprising controlling the light sources using the light controller.

19. A linear lighting assembly for mounting to a surface, the assembly comprising:

a plurality of lighting units connected generally end-to-end;

each lighting unit having an extruded, non-metallic base and an extruded, non-metallic cover removably attached to the base, the attached base and cover defining a first elongated compartment holding an LED strip or module, and a second elongated compartment concealing one or more electrical wires for providing power to one or more LED lighting strips or modules positioned in one or more adjacent lighting units.

20. The linear lighting assembly as in claim 19, wherein the one or more wires in the second compartment provides power to an LED strip of module held in the first compartment of an adjacent lighting unit.

21. The linear lighting assembly as in claim 19, wherein each of the covers provides a window for emitting light therethrough.

22. The linear lighting assembly as in claim 21, wherein each of the LED lighting strips or modules has a plurality of light sources, the light sources positioned to emit light through the window of the cover.

23. The linear lighting assembly of claim 19, wherein each of the covers comprises an opaque stripe.

24. The linear lighting assembly of claim 23, wherein each of the covers comprises a transparent or translucent stripe adjacent the opaque stripe.

* * * * *